US007882904B2

(12) United States Patent
von Gynz-Rekowski et al.

(10) Patent No.: US 7,882,904 B2
(45) Date of Patent: Feb. 8, 2011

(54) ADJUSTABLE BENT HOUSING APPARATUS AND METHOD

(75) Inventors: Gunther H H von Gynz-Rekowski, Montgomery, TX (US); William Christian Herben, Magnolia, TX (US); Daryl Elliot Bolejack, Magnolia, TX (US)

(73) Assignee: Ashmin, LC, Conroe, TX (US)

( * ) Notice: Subject to any disclaimer, the term of this patent is extended or adjusted under 35 U.S.C. 154(b) by 193 days.

(21) Appl. No.: 12/004,346

(22) Filed: Dec. 20, 2007

(65) Prior Publication Data

US 2009/0159339 A1 Jun. 25, 2009

(51) Int. Cl.
*E21B 7/06* (2006.01)

(52) U.S. Cl. ..... 175/74; 175/61; 175/256; 464/19

(58) Field of Classification Search ..... 175/61.74, 175/256; 464/19
See application file for complete search history.

(56) References Cited

U.S. PATENT DOCUMENTS

| | | | | |
|---|---|---|---|---|
| 4,077,657 | A | | 3/1978 | Trzeciak |
| 4,522,272 | A | | 6/1985 | Beimgraben |
| 4,745,982 | A | | 5/1988 | Wenzel |
| 4,811,798 | A | | 3/1989 | Falgout, Sr. et al. |
| 4,813,497 | A | | 3/1989 | Wenzel |
| 4,817,740 | A | | 4/1989 | Beimgraben |
| 5,029,654 | A | | 7/1991 | Wilson et al. |
| 5,101,915 | A | | 4/1992 | Witte |
| 5,125,463 | A | | 6/1992 | Livingstone et al. |
| 5,139,094 | A | * | 8/1992 | Prevedel et al. ..... 175/61 |
| 5,248,004 | A | | 9/1993 | Witte |
| 5,343,966 | A | | 9/1994 | Wenzel et al. |
| 5,479,995 | A | | 1/1996 | Falgout, Sr. |
| 5,495,901 | A | | 3/1996 | Livingstone et al. |
| 6,543,554 | B2 | | 4/2003 | Smith |
| 6,554,083 | B1 | | 4/2003 | Kenstetter |
| 6,799,646 | B1 | | 10/2004 | Daigle et al. |

* cited by examiner

*Primary Examiner*—David J Bagnell
*Assistant Examiner*—Sean D Andrish
(74) *Attorney, Agent, or Firm*—Jones Walker

(57) ABSTRACT

An apparatus for controlling the direction of drill bit within a wellbore. The apparatus comprises a first housing with a first housing axis therein, and wherein the first housing has a first threaded opening having a first threaded opening axis. The first housing has a helical end. A second housing is included, and the second housing contains a second housing axis, and a second threaded opening having a second threaded opening axis configured to engage with the first threaded opening. A collar is included that has a helical collar end that engages the helical collar end and wherein the helical collar end is configured reciprocal to the helical end, and rotational displacement of the first housing relative to the collar will angularly displace the drill bit axis. The apparatus may further include spline members for locking the collar in place relative to the first and second housing.

24 Claims, 7 Drawing Sheets

ADJUSTABLE BENT HOUSING APPARATUS AND METHOD

BACKGROUND OF THE INVENTION

This invention relates to an apparatus for adjusting the orientation of a tubular. More specifically, but not by way of limitation, this invention relates to an adjustable bent housing apparatus, and a method of using the bent housing.

In the search for hydrocarbon deposits, operators have found it desirable to drill deviated and horizontal wells. As those of ordinary skill in the art will recognize, there are numerous advantages to being able to drill directional wells. For instance, an operator may drill a horizontal well for hundreds of feet within a subterranean reservoir, thus enabling high rates of production of hydrocarbons once completed. Additionally, an operator may wish to drill several lateral wells from a single surface location. This list is meant to be illustrative.

In order to obtain the angle of inclination necessary to drill these wellbores, numerous types of directional drilling apparatuses have been developed. One prior art technique includes use of a bent housing as part of the downhole mud motor. However, prior art downhole mud motors suffer from many deficiencies. For instance, some prior art devices require that the entire bent housing section be replaced if the operator wishes to adjust the drill bit axis relative to the bore hole.

Therefore, an object of the present invention is an adjustable bent housing apparatus that can be adjusted on the drilling rig without the need to have a large inventory of bent housing sections at the drilling rig site. Another object of the present invention includes an apparatus that is durable and can withstand the tremendous stress placed on downhole equipment in the drilling process. Yet another object is the development of a system that accurately adjust the drill bit axis relative to the work string. These and many other objects will become apparent upon a reading of the following description.

SUMMARY OF THE INVENTION

An apparatus for controlling the direction of drill bit within a wellbore is disclosed, and wherein the drill bit has as a drill bit axis and the drill bit is connected to the apparatus. In one embodiment, the apparatus comprises a first housing with a first housing axis therein, and wherein the first housing has a first threaded opening having a first threaded opening axis. The first housing has a helical end. A second housing is included, and the second housing contains a second housing axis, and a second threaded opening having a second threaded opening axis configured to engage with the first threaded opening, and wherein the second housing has an end surface.

The apparatus further includes a collar having a radial collar end and a partial helical collar end, and wherein the radial collar end engages the end surface and the helical collar end engages the helical end, and wherein the partial helical collar end is configured reciprocal to the helical end, and rotational displacement of the first housing relative to the collar will angularly displace the first threaded opening axis from the second threaded opening axis so that the inclination of the bit axis is changed. The apparatus may further include means for locking the collar in place relative to the first and second housing.

In one embodiment, the locking means includes a reciprocal set of splines. The splines may also be referred to as teeth, keys, or teeth or key like projections. The splines may also be referred to as a mechanical interlocking mechanism. More specifically, in one preferred embodiment, the locking means comprises a male set of splines formed on an inner portion of the collar and a female set of splines formed on an inner portion of the first housing. In another embodiment, the locking means comprises a female set of splines formed on an inner portion of the collar and a male set of splines formed on an inner portion of the second housing. Additionally, in one preferred embodiment, the first threaded opening is configured perpendicular to the helical end and the second threaded opening is configured perpendicular to the end surface.

The first housing may have disposed therein an output shaft of a drilling motor, and the second housing may have disposed therein a drive shaft of the drilling motor, and wherein the drive shaft is connected to the drill bit. In one preferred embodiment, the helical collar end has a slope between 0.1 degrees and 10 degrees, and the helical end has a complimentary slope.

A method of drilling a well with a drill bit is also disclosed. The method comprises providing a drill assembly within the well, with the drill assembly being connected to the drill bit via a drive shaft. The assembly comprises a first housing with a first housing axis therein, with the first housing having a first threaded opening having a first threaded opening axis, and wherein the first housing has a helical end. The tool further includes a second housing having a second housing axis, with the second housing having a second threaded opening having a second threaded opening axis configured to engage with the first threaded opening, and wherein the second housing having an end surface. The housing also includes a collar having a radial collar end and a helical collar end, and wherein the radial collar end engages the end surface and the helical collar end engages the helical end, and wherein the helical collar end is at a reciprocal angle to the helical end. The method further includes drilling the well with the drill bit at a first angle of inclination.

The method further comprises retrieving the drill assembly from the well, unscrewing the first housing from the second housing, and rotating the collar relative to the first housing hence axial displacing the radial end surface of the collar to the first housing. The method further includes adjusting the collar's axial position relative to the first housing and the second housing, by rotationally moving the collar relative to the first housing and therefore displacing the first housing relative to the collar in order to angularly displace the drill bit at a second angle of inclination. Next, the first housing is locked with the second housing. The method includes running into the well with the drill bit and drilling the well at the second angle of inclination.

In one preferred embodiment, the step of locking the first housing with the collar includes engaging a spline located on said collar with a spline located on the first housing.

In another preferred embodiment, the step of locking the first housing with the second housing includes engaging a thread connection located on the first housing with a thread connection located on the second housing.

In one preferred embodiment, the step of adjusting the axial inclination includes rotational displacement of the first housing relative to the collar in order to align the first housing axis with the second housing axis. In another preferred embodiment, the step of adjusting the axial inclination includes rotational displacement of the first housing relative to the collar so that the first housing axis and the second housing axis is angularly displaced. In yet another embodiment, the step of adjusting the collar's axial position includes rotation displacement of the first housing relative to the collar so that the radial end surface of the collar is axially displaced.

In another preferred embodiment, an apparatus for controlling the direction of a tubular is disclosed. In this embodiment, the apparatus comprises a first housing with a first housing axis therein, with the first housing having a first threaded opening having a first threaded opening axis offset from the first housing axis, and wherein the first housing has a helical end. The apparatus includes a second housing having a second housing axis, with the second housing having a second threaded opening having a second threaded opening axis offset from the second housing axis and wherein the second threaded opening is configured to engage with the first threaded opening, and wherein the second housing has an end surface.

Additionally, this embodiment includes a collar having a radial collar end and a helical collar end, and wherein the radial collar end engages the end surface and the helical collar end engages the helical end, and wherein the helical collar end is configured reciprocal to the helical end. In a first position, rotational displacement of the first housing relative to the collar will align the first housing axis with the second housing axis and in a second position, rotational displacement of the first housing relative to the collar will deviate the first housing axis relative to the second housing axis. Means for locking the collar in place relative to the first and second housing may also be included.

An advantage of the present invention is that angular adjustments can be made to the downhole motor assembly without the need for spare inventory at the rig site. The collar can be adjusted in the field. Another advantage is that the driller on the drill rig floor can make accurate changes to the orientation of the drill bit axis for precision geo-steering. Yet another advantage is that the driller can quickly make angular adjustments to the drill bit axis.

Yet another advantage is that the apparatus can be used for controlling the direction of a tubular, wherein the tubular can be used in applications wherein it is necessary to change and/or adjust the orientation of the tubular i.e. when a bend is needed in a tubular.

A feature of the present invention is the first and second housing that share a common axis, and wherein this common axis is offset from the axis of the threaded openings contained within the first and second housing. Another feature is a collar that contains a helical end profile that mates with a reciprocal profile end face on one of the housings. Yet another feature is the splines on the collar and the mating splines of the housing which allow for locking the desired angular displacement into the drilling assembly.

DETAILED DESCRIPTION OF THE PREFERRED EMBODIMENTS

Figure 1:
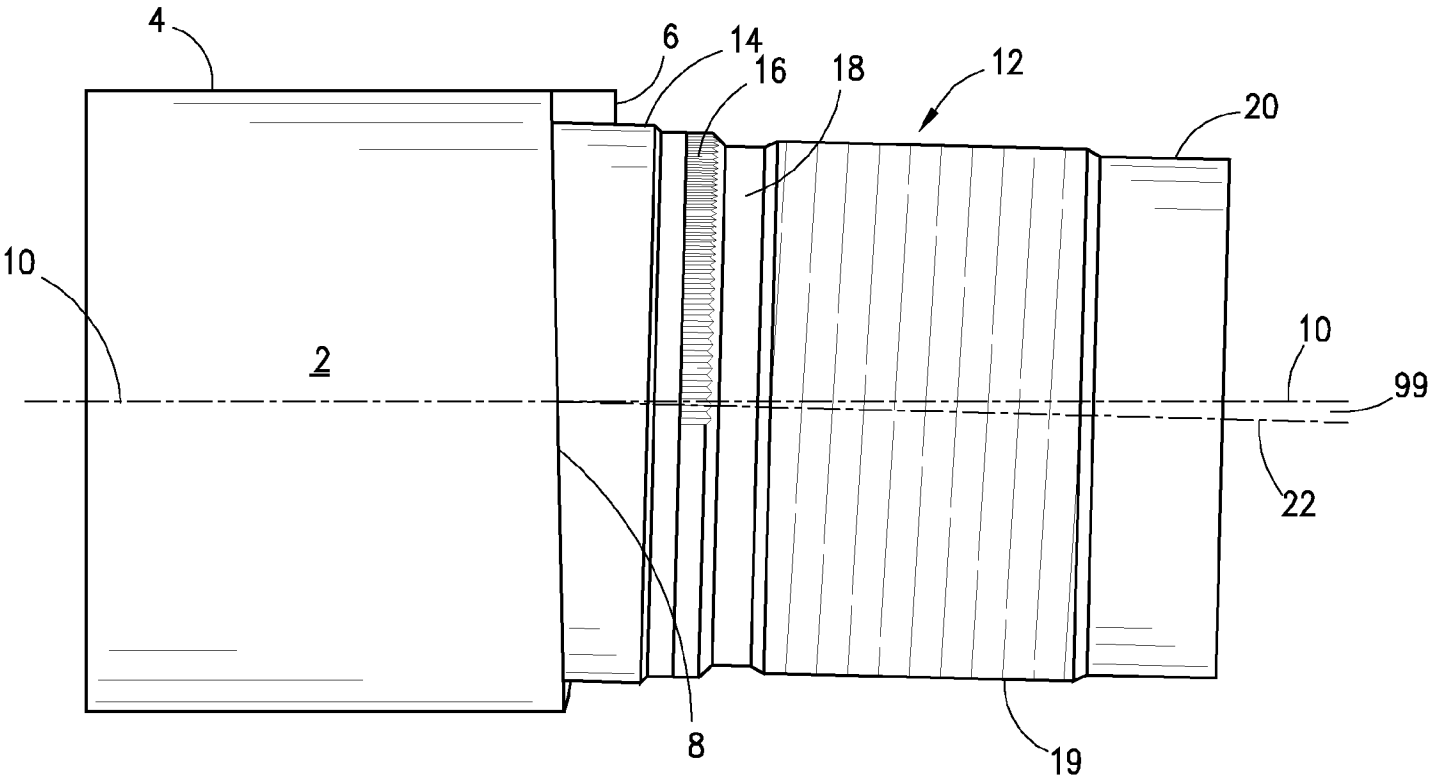
FIG. 1 is a planar view of the first housing of the preferred embodiment.

Referring now to FIG. 1, a planar view of the first housing 2 of the most preferred embodiment will now be described. The first housing 2 has a first outer cylindrical surface 4 that extends to surface 6, and wherein the surface 6 has a generally helical profile 8. The first outer cylindrical surface 4 will have an inner portion (not shown in this view), and wherein the dashed line 10 depicts the center axis of the portion formed from cylindrical surface 4.

Extending from the surface 6 will be the threaded opening seen generally at 12, sometimes referred to as the pin connection 12. The threaded opening 12 includes the outer cylindrical surface 14 that extends to the outer spline members seen generally at 16 which in turn extends to the indentation 18. The splines are teeth-like projections extending from the pin connection 12. As seen in FIG. 1, the indentation 18 stretches to the external threads 19, and wherein the threaded opening surface 12 has external threads 19. The external threads 19 terminate at the outer cylindrical surface 20. The center axis of the threaded opening 12 is represented by the dashed line 22. As per the teachings of the present invention, the center axis 22 is offset from the center axis 10, as shown in FIG. 1 by the numeral 99.

Figure 2A:
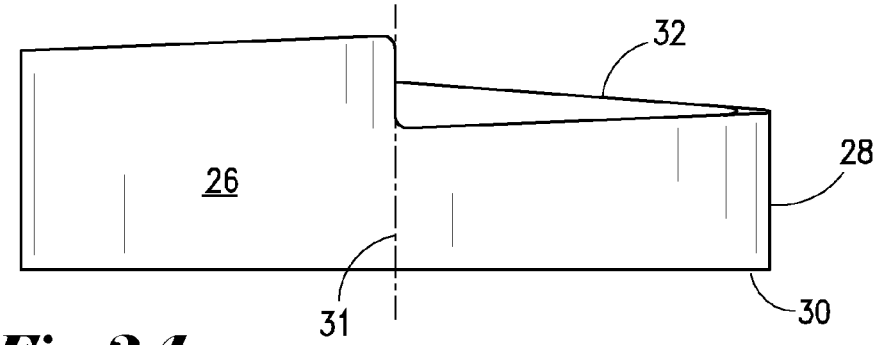
FIG. 2A is a planar view of the collar of the preferred embodiment.

Referring now to FIG. 2A, a planar view of the preferred embodiment of the collar 26 will now be described. The collar 26 includes an outer cylindrical surface 28 that extends to the first radial end 30. It should be noted that like numbers appearing in the various figures refer to like components. The collar 26 has a center of axis 31. The collar 26 also contains the collar helical end profile, seen generally at 32, and wherein the collar helical end profile 32 is reciprocal to and configured to engage the helical profile 8 (helical profile 8, seen in FIG. 1). The helical profile 8 may also be referred to as a cam surface 8, and the collar helical end profile 32 may be referred to as a ramp 32.

Figure 2B:
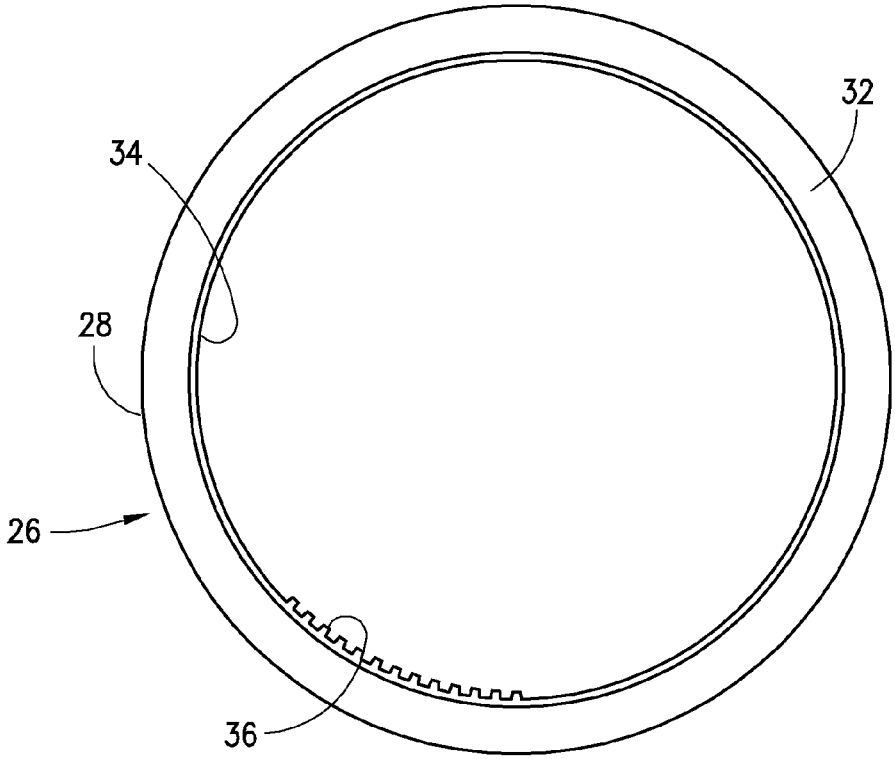
FIG. 2B is a top view of the collar seen in FIG. 2A.
Figure 2C:
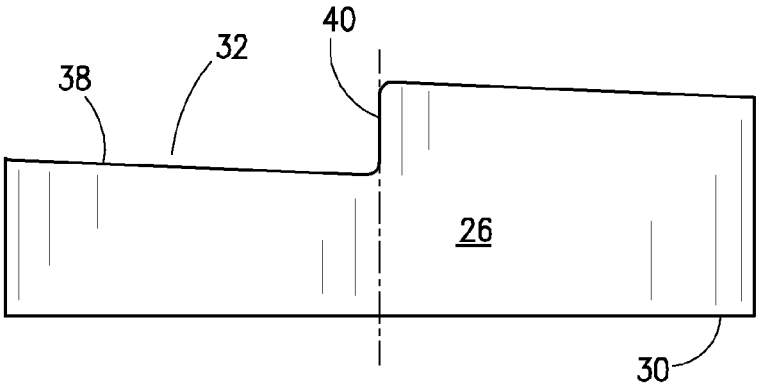
FIG. 2C is a planar view of the unwrap length of the collar depicted in FIG. 2A.

FIG. 2B is a top view of the collar 26 seen in FIG. 2A. The collar helical end profile 32 is shown, along with the outer cylindrical surface 28. The collar 26 contains the inner diameter surface 34, and wherein the inner diameter surface 34 contains the splines 36 (sometimes referred to as the female set of splines 36). The splines 36 will engage with the splines 16 in order to lock the collar 26 in position relative to the first housing 2 as will be more fully explained later in the description. FIG. 2C is a planar view of the entire length (i.e. unwrapped view) of the collar 26 seen in FIG. 2A, and wherein the collar helical end profile 32 is illustrated. The profile 32 has a sloping surface 38 that extends to the upward facing shoulder 40, wherein the upward facing shoulder 40 extends to the sloping surface 38. As noted earlier, the profile 32 is configured to engage with the helical profile 8 of the first housing 2. The first radial end 30 is also shown.

Figure 3:
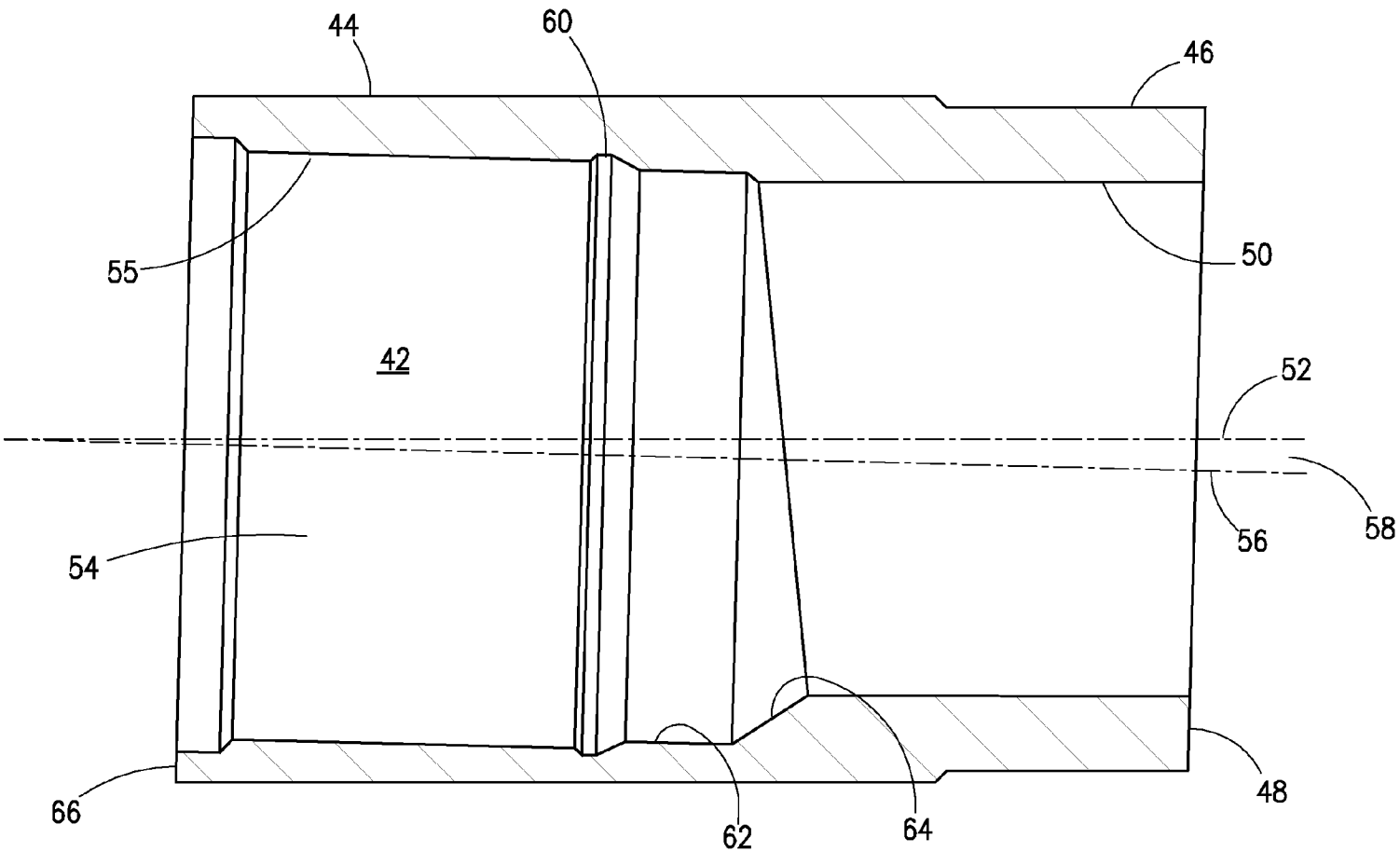
FIG. 3 is a cross-sectional view of the second housing of the preferred embodiment.

Referring now to FIG. 3, a cross-sectional view of the preferred embodiment of the second housing 42 will now be described. The second housing 42 is generally cylindrical in shape. The second housing 42 has a first outer surface 44 that extends to the second, smaller outer diameter surface 46 which terminates at the radial end 48. Extending radially inward is the inner diameter portion 50. The inner diameter portion 50 has a center of axis denoted by the dashed line 52, which is also the center of axis for the cylindrical outer surfaces 44, 46.

FIG. 3 also illustrates the threaded opening, seen generally at 54 (sometimes referred to as the box connection 54), and wherein the threaded opening 54 is configured to engage the threaded opening 12. As shown in FIG. 3, the threaded opening 54 is tilted (i.e. inclined) relative to the outer surfaces 44, 46. The threaded opening 54 contains internal threads 55. As illustrated in FIG. 3, the threaded opening 54 has a center of axis denoted by the dashed line 56 (sometimes referred to as the titled box angle), and wherein the center of axis 56 is offset from the center of axis 52 by the angle denoted 58, which in the most preferred embodiment is between 1.5 and 2.0 degrees. The box connection 54 extends to the indentation 60 which in turn extends to the inner surface 62. The inner surface 62 then extends to the eccentric inner surface 64, and wherein the eccentric inner surface 64 allows for the junction of the inner diameter portion 50 and the inner surface 62. The second housing 42 contains the radial end 66.

Figure 4A:
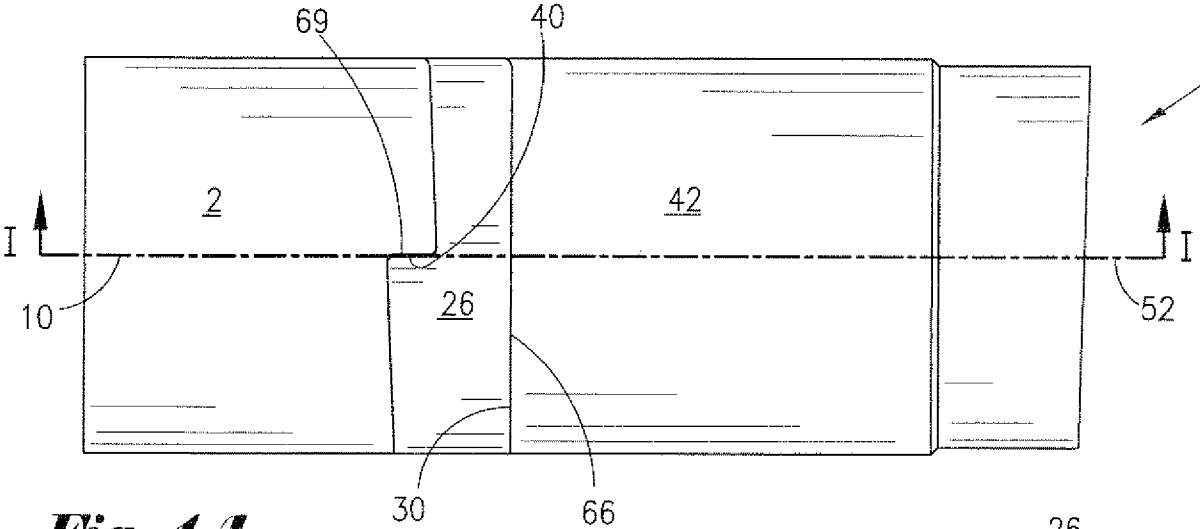
FIG. 4A is a planar view of the assembled apparatus of the preferred embodiment at a zero degree angle of inclination orientation.

FIG. 4A is a planar view of the assembled apparatus 68 (sometimes referred to as the adjustable bent sub 68) of the preferred embodiment at a zero degree angle of inclination orientation. As shown, the shoulder 40 of the collar 26 abuts the shoulder 69 of the first housing 2. Also, the radial end 30 of the collar 26 abuts the radial end 66 of the second housing 42. As shown, the center of axis 10 of the housing 2 and the center of axis 52 of the housing 42 are aligned, and therefore, at zero orientation.

Figure 4B:
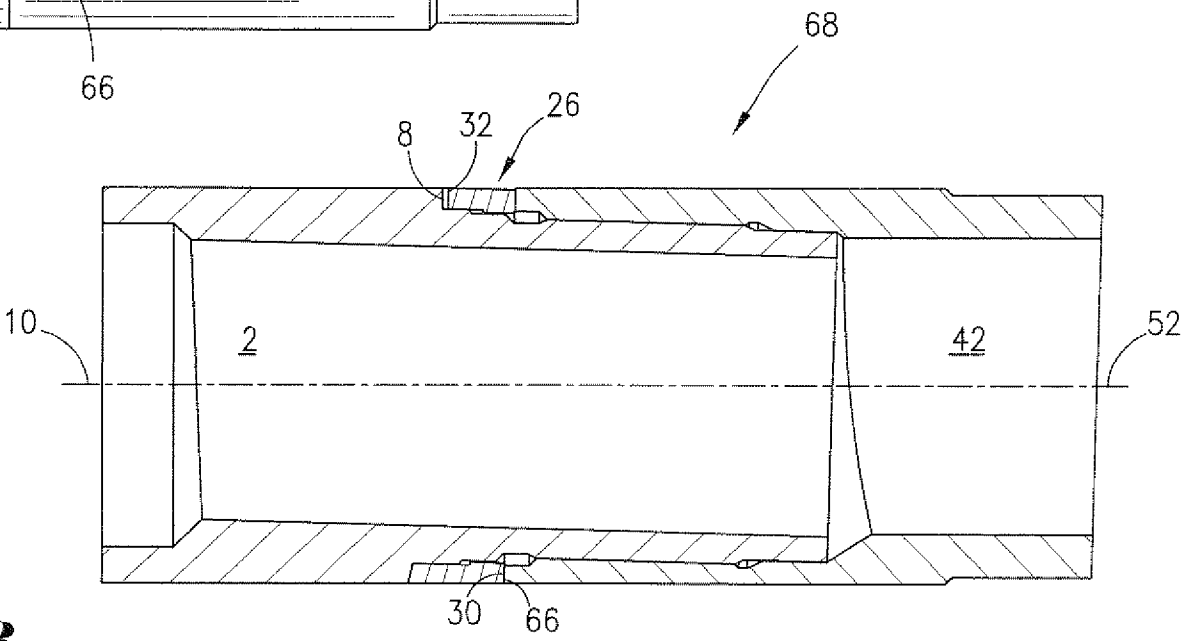
FIG. 4B is a cross-section view of the apparatus seen in FIG. 4A.

FIG. 4B is a cross-section view of the assembled apparatus 68 taken along line I-I from FIG. 4A. FIG. 4B depicts the engagement of the collar helical end profile 32 with the helical profile 8 as well as the radial end 30 abutting the radial end 66. The first housing 2 is threadedly connected to the second housing 42. As oriented in FIGS. 4A and 4B, the axis of the assembled apparatus 68 would be aligned with the drill bit axis.

Figure 5A:
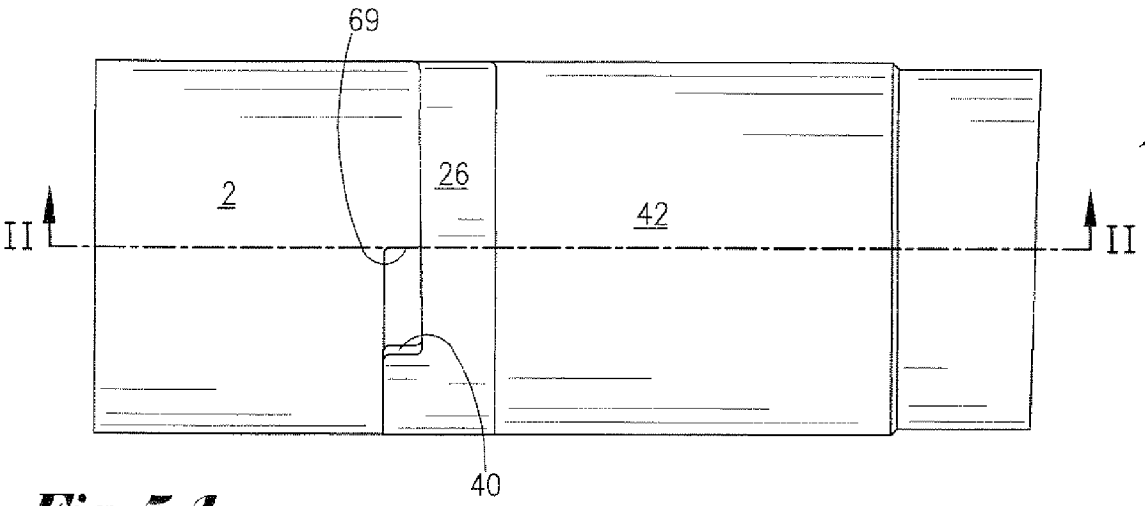
FIG. 5A is a planar view of the assembly apparatus of the preferred embodiment at a one hundred and eighty degree (180) angle of inclination orientation.
Figure 5B:
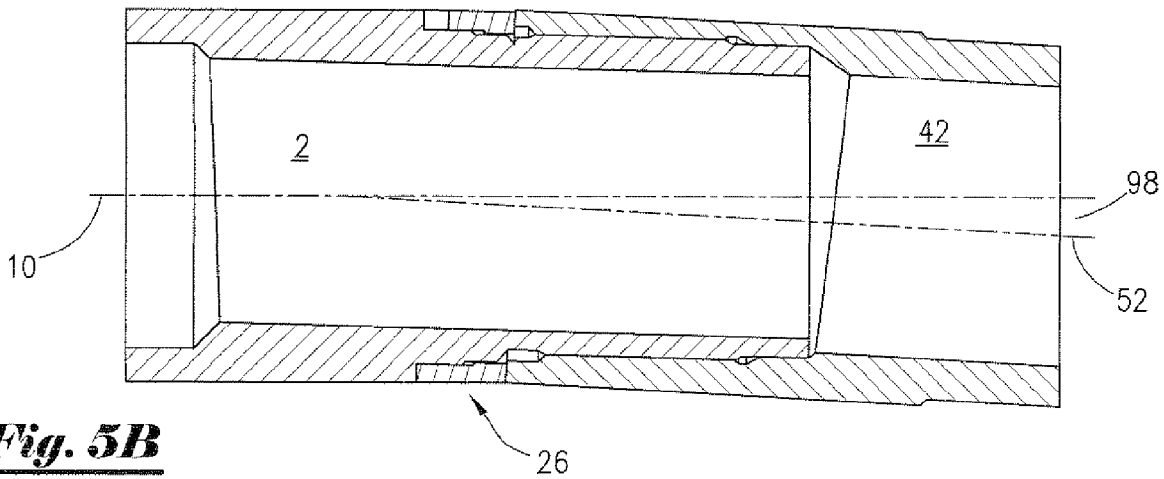
FIG. 5B is a cross-section view of the apparatus seen in FIG. 5A.

FIG. 5A is a planar view of the assembled apparatus 68 of the preferred embodiment at a 180 degree angle of inclination orientation. In this embodiment, the first housing 2 and the second housing 42 have been separated, and the collar 26 has been repositioned by removing from the spline means, rotationally repositioning the spline means, and then threadedly connecting the first housing 2 and the second housing 42. Hence, the shoulder 40 of collar 26 has been rotationally separated from the shoulder 69 of first housing 2, as seen in FIG. 5A. FIG. 5B is a cross-section view of the assembled apparatus 68 taken along line II-II of FIG. 5A. FIG. 5B depicts the center axis 10 of the first housing 2 as well as the center of axis 52 of the second housing 42. The numeral 98 depicts the angle of inclination which is 2 to 4 degrees.

The numeral angle 98 would be the sum of the tilted box angle 58 and the first housing angle 99 (angle between item 10 and item 22 seen in FIG. 1) with 180 degree angle of inclination rotation.

As oriented in FIGS. 5A and 5B, the center of axis 52 would be offset from the drill bit axis. Put another way, the assembled apparatus 68 represents an adjustable bent sub of a downhole motor assembly in the tilted mode due to the 2 to 4 degree angle of inclination, or more preferably a 3 to 4 degree angle of inclination.

Figures 6A, 6B:
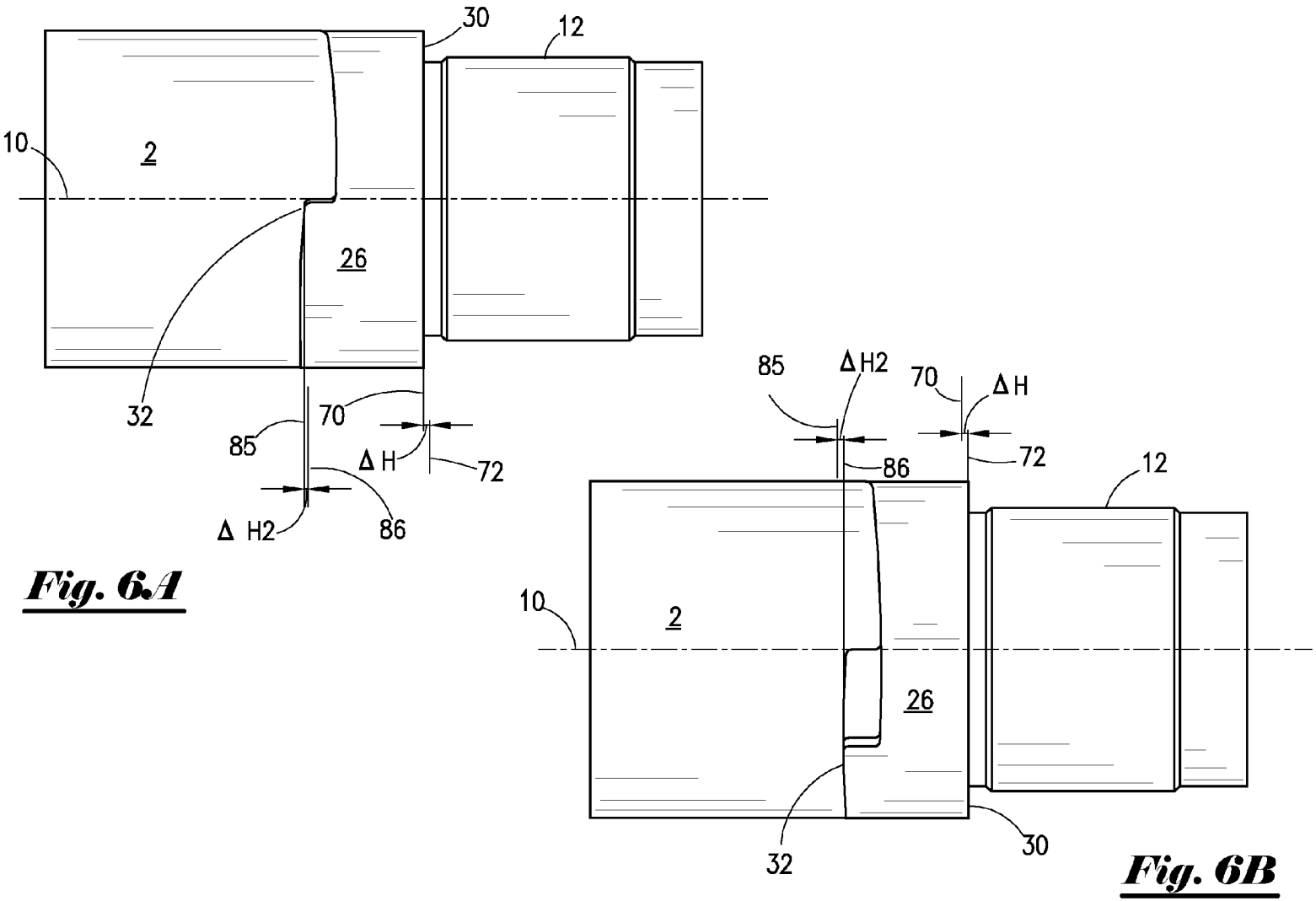
FIG. 6A is a planar view of the first housing and collar at a zero (0) degree angle of inclination orientation.
FIG. 6B is a planar view of the first housing and collar at a one hundred and eighty (180) degree angle of inclination orientation.

Referring now to FIG. 6A, a planar view of the first housing 2 and the collar 26 at zero (0) degree angle of inclination orientation will now be described. This view is the view of FIGS. 4A and 4B, except the second housing 42 has been removed. Note that the line 70 represents the level of the radial end 30 and line 85 represents the level of helical collar end 32 adjacent shoulder 40. In FIG. 6B, which is planar view of the first housing 2 and collar 26 at a one hundred and eighty (180) degree angle of inclination orientation, the collar 26 has been rotationally displaced by lifting the collar 26 from the splines and repositioning the collar 26 onto the splines (i.e. the collar 26 has been rotated relative to the first housing 2). Hence, the collar 26 was disengaged from the spline means, rotated, and the spline means were then re-engaged to the position seen in FIG. 6B. The line 72 represents the level of the radial end 30 relative to the previous level 70 after this rotational displacement. The line 86 represents the level of the helical collar end 32 adjacent shoulder 40. Moreover, the delta H represents the amount of lateral movement of radial end 30 after the rotational displacement and the delta H2 represents the amount of lateral movement of helical shoulder end 32 adjacent shoulder 40 after the rotational displacement.

Figure 7:
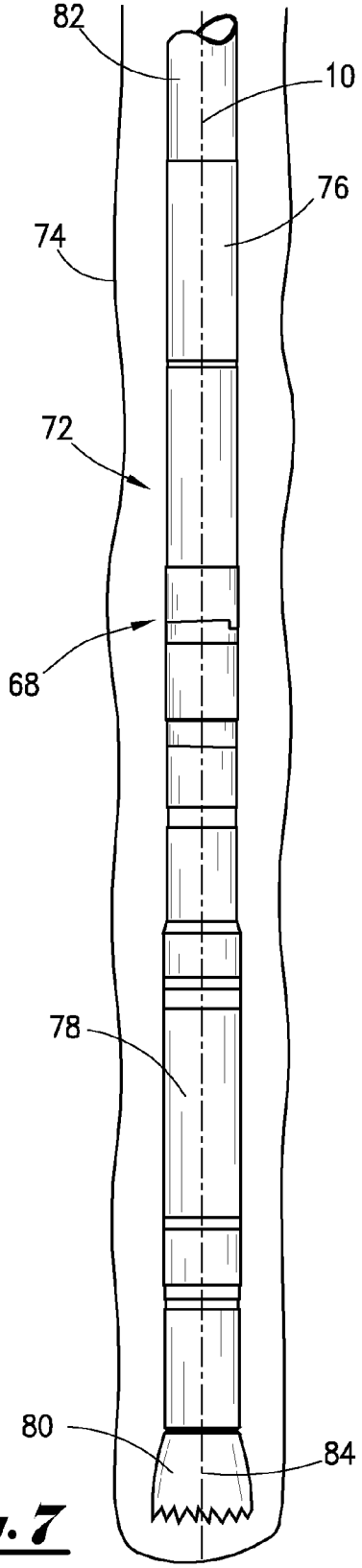
FIG. 7 is a schematic view of the mud motor of the present invention in a straight orientation within a wellbore.

As mentioned earlier, the adjustable bent sub 68 will be part of a downhole mud motor assembly used in drilling subterranean reservoirs. Referring now to FIG. 7, which is a schematic view of a mud motor assembly, seen generally at 72, within a wellbore 74. As readily understood by those of ordinary skill in the art, the mud motor 72 contains the power section 76, the adjustable bent housing apparatus 68 and the bearing section 78. The bearing section contains a drive shaft (DS) that will be connected to the drill bit 80 for drilling the wellbore 74. The power section 76 contains an output shaft (OS) that is connected to the drive shaft (DS). The power section generates a rotational movement to the output shaft (OS), which in turn is transferred to the drive shaft. The drill bit 80 will be turned by the drive shaft in order to drill the wellbore 74. The downhole mud motor assembly 72 is connected to a work string 82.

Figure 8:
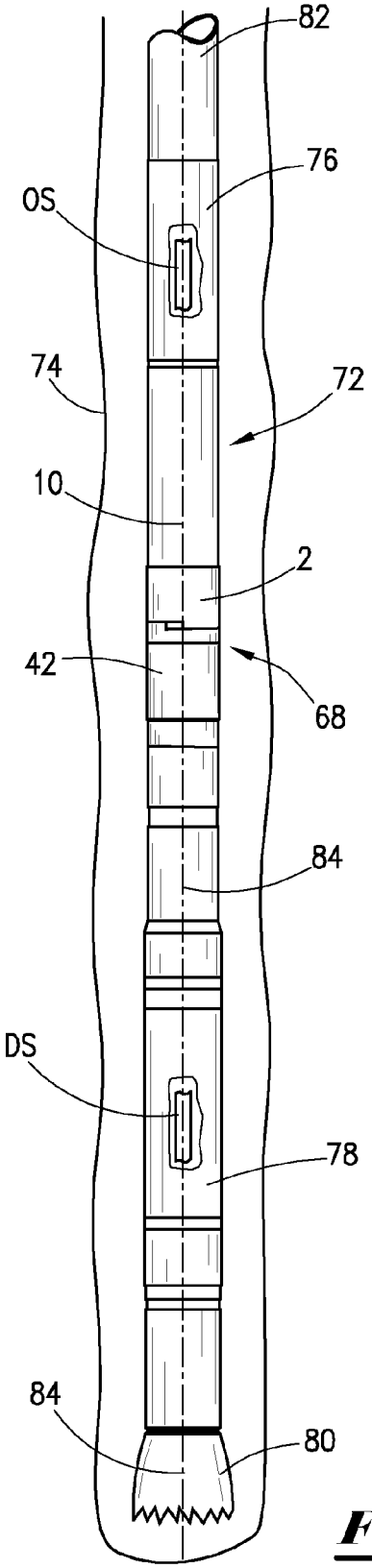
FIG. 8 is a schematic view of the mud motor of FIG. 7 in a bent orientation within a wellbore.

As seen in FIG. 7, the adjustable sub 68 is oriented in the straight mode i.e. the center of axis 84 of the drill bit 80 is aligned with the center of axis 10 of the first housing 2. FIG. 8 is a schematic view of the mud motor of FIG. 7 in a bent orientation within the wellbore 74. More specifically, the center of axis 10 of the first housing 2 is offset by an angle of three (3) degrees relative to the center of axis 84 of the lower housing 42. As seen in FIG. 8, the drill bit 80 will drill in a deviated direction due to the adjustable bent sub's orientation.

Although the invention has been described in terms of specified embodiments which are set forth in detail, is should be understood that this is by illustration only and that the invention is not necessarily limited thereto, since alternative embodiments and cooperating techniques will become apparent to those skilled in the art in view of the disclosure. Accordingly, modifications are contemplated which can be made without departing from the spirit of the described invention.

We claim:

1. An apparatus for controlling the direction of a drill bit within a wellbore, wherein said drill bit has as a drill bit axis and wherein the drill bit is connected to the apparatus, the apparatus comprising:

a first housing with a first housing axis therein, said first housing having a first outer cylindrical surface having a cam end surface, said first housing having a first threaded opening having a first threaded opening axis, and wherein said first threaded opening extends from said cam end surface, wherein an axial length of said first outer cylindrical surface varies along a circumference of said cam end surface from a maximum axial length to a minimum axial length, and wherein said cam end surface comprises a cam shoulder interconnecting said maximum axial length and said minimum axial length;

a second housing having a second housing axis, said second housing having a second threaded opening having a second threaded opening axis configured to engage with said first threaded opening, and wherein said second housing having an end surface;

a collar having a radial collar end and a collar cam end surface, wherein a collar axial length of said collar varies along a circumference of said collar cam end surface from a maximum collar axial length to a minimum collar axial length, wherein said collar cam end surface comprises a collar cam shoulder interconnecting said maximum collar axial length and said minimum collar axial length, and wherein said radial collar end engages said end surface of said second housing and said collar cam end surface engages said cam end surface of said first outer cylindrical surface, and wherein said collar cam end surface is configured reciprocal to the cam end surface, and rotational displacement of said first housing relative to the collar will angularly displace the first housing axis from the second housing axis so that the inclination of said drill bit axis is changed.

2. The apparatus of claim 1 wherein said first threaded opening contains external thread means and said second threaded opening contains internal thread means.

3. The apparatus of claim 1 further comprising a female set of splines formed on an inner portion of said collar and a male set of splines formed on an outer portion of said first housing.

4. The apparatus of claim 3 wherein said first housing has disposed therein an output shaft of a drilling motor.

5. The apparatus of claim 4 wherein said second housing has disposed therein a drive shaft of the drilling motor, and wherein the drive shaft is connected to said drill bit.

6. The apparatus of claim 5 wherein said collar cam end surface has a slope between 0.1 degrees and 10 degrees.

7. An apparatus for controlling the direction of a drill bit within a wellbore, wherein said drill bit has as a drill bit axis, the apparatus comprising:

a first housing with a first housing axis therein, said first housing having a first outer cylindrical surface having a cam end surface, said first housing having a first threaded opening having a first threaded opening axis, and wherein said first threaded opening extends from said cam end surface, wherein an axial length of said first outer cylindrical surface varies along a circumference of said cam end surface from a maximum axial length to a minimum axial length, and wherein said cam end surface comprises a cam shoulder interconnecting said maximum axial length and said minimum axial length;

a second housing having a second housing axis, said second housing having a second threaded opening having a second threaded opening axis configured to engage with said first threaded opening, and wherein said second housing having an end surface;

a collar having a radial collar end and a collar cam end surface, wherein a collar axial length of said collar varies along a circumference of said collar cam end surface from a maximum collar axial length to a minimum collar axial length, wherein said collar cam end surface comprises a collar cam shoulder interconnecting said maximum collar axial length and said minimum collar axial length, and wherein said radial collar end engages said end surface of said second housing and said collar cam end surface engages said cam end surface of said first outer cylindrical surface, and wherein said collar cam end surface is configured reciprocal to the cam end surface, and rotational displacement of said first housing relative to the collar will angularly displace the inclination of the drill bit axis;

means for locking said collar in place relative to said first housing and said second housing.

8. The apparatus of claim 7 wherein said locking means comprises a female set of splines formed on an inner portion of said collar and a male set of splines formed on an outer portion of said first housing.

9. The apparatus of claim 8 wherein said first threaded opening contains external thread means and said second threaded opening contains internal thread means.

10. The apparatus of claim 9 wherein said first housing has disposed therein an output shaft of a drilling motor.

11. The apparatus of claim 10 wherein said second housing has disposed therein a drive shaft of the drilling motor, and wherein the drive shaft is connected to said drill bit.

12. The apparatus of claim 11 wherein said collar cam end surface has a slope between 0.1 degrees and 10 degrees.

13. The apparatus of claim 11 wherein said cam end surface has a slope between 0.1 degrees and 10 degrees.

14. A method of drilling a well with a drill bit comprising:

providing a drill tool assembly within the well, said drill tool assembly being connected to the drill bit via a drive shaft, said drill tool assembly comprising: a first housing with a first housing axis therein, said first housing having a first outer cylindrical surface having a cam end surface, said first housing having a first threaded opening having a first threaded opening axis, and wherein said first threaded opening extends from said cam end surface, wherein an axial length of said first outer cylindrical surface varies along a circumference of said cam end surface from a maximum axial length to a minimum axial length, wherein said cam end surface comprises a cam shoulder interconnecting said maximum axial length and said minimum axial length; a second housing having a second housing axis, said second housing having a second threaded opening having a second threaded opening axis configured to engage with said first threaded opening, and wherein said second housing having an end surface; a collar having a radial collar end and a collar cam end surface, wherein a collar axial length of said collar varies along a circumference of said collar cam end surface from a maximum collar axial length to a minimum collar axial length, wherein said collar cam end surface comprises a collar cam shoulder interconnecting said maximum collar axial length and said minimum collar axial length, and wherein said radial collar end engages said end surface of said second housing and said collar cam end surface engages said cam end surface of said first outer cylindrical surface, and wherein said collar cam end surface is at a reciprocal angle to the cam end surface;

drilling the well with the drill bit at a first angle of inclination;

retrieving the drill tool assembly from the well;

unscrewing said first housing and said second housing;

rotating the collar from said first housing;

adjusting the collar's axial position relative to said first housing and said second housing, by rotationally displacing said first housing relative to the collar in order to angularly displace the drill bit at a second angle of inclination;

locking said first housing with said second housing;

running into the well with the drill tool assembly;

drilling the well at said second angle of inclination.

15. The method of claim 14 wherein the step of locking said first housing with said second housing includes engaging a first tooth projection located on said collar with a second tooth projection located on said first housing.

16. The method of claim 15 wherein said collar cam end surface contains a slope between 0.1 degrees and 10 degrees.

17. The method of claim 16 wherein said drilling tool assembly further includes a drill motor means for rotating said drill bit.

18. The method of claim 17 wherein said drill motor means includes a drive shaft connected to said drill bit in order to rotate the drill bit, and wherein said drive shaft is disposed through said second housing.

19. The method of claim 15 wherein the step of adjusting the collar's axial position includes rotational displacement of said first housing relative to said collar in order to align said first housing axis with said second housing axis.

20. The method of claim 15 wherein the step of adjusting the collar's axial position includes rotational displacement of said first housing relative to said collar so that said first housing axis and said second housing axis are angularly displaced.

21. The method of claim 15 wherein the step of adjusting the collar's axial position includes rotational displacement of said first housing relative to said collar so that the radial end surface of said collar is axially displaced.

22. An apparatus for controlling the direction of a tubular, the apparatus comprising:

a first housing with a first housing axis therein, said first housing having a first outer cylindrical surface having a cam end surface, said first housing having a first threaded opening having a first threaded opening axis offset from said first housing axis, and wherein said first threaded opening extends from said cam end surface, wherein an axial length of said first outer cylindrical surface varies along a circumference of said cam end surface from a maximum axial length to a minimum axial length, and wherein said cam end surface comprises a cam shoulder interconnecting said maximum axial length and said minimum axial length;

a second housing having a second housing axis, said second housing having a second threaded opening having a second threaded opening axis offset from said second housing axis and wherein said second threaded opening is configured to engage with said first threaded opening, and wherein said second housing having an end surface;

a collar having a radial collar end and a collar cam end surface, wherein a collar axial length of said collar varies along a circumference of said collar cam end surface from a maximum collar axial length to a minimum collar axial length, wherein said collar cam end surface comprises a collar cam shoulder interconnecting said maximum collar axial length and said minimum collar axial length, and wherein said radial collar end engages said end surface of said second housing and said collar cam end surface engages said cam end surface of said first outer cylindrical surface, and wherein said collar cam end surface is configured reciprocal to the cam end surface; and wherein in a first position, rotational displacement of said first housing relative to the collar will align said first housing axis with said second housing axis and in a second position, rotational displacement of said first housing relative to the collar will deviate the first housing axis relative to said second housing axis;

means for locking said collar in place relative to said first housing and said second housing.

23. The apparatus of claim 22 wherein said locking means comprises a set of splines formed on said collar and a set of splines formed on said first housing.

24. The apparatus of claim 23 wherein the tubular is connected to a drill bit and the tubular is disposed within a wellbore.

* * * * *